United States Patent [19]

Kanda

[11] Patent Number: 5,005,012

[45] Date of Patent: Apr. 2, 1991

[54] METHOD OF ARRANGING DATA ON A RAM FOR DISPLAY

[75] Inventor: Kunio Kanda, Kokubunji, Japan

[73] Assignee: Fanuc Ltd, Minamitsuru, Japan

[21] Appl. No.: 184,486

[22] PCT Filed: Jul. 16, 1987

[86] PCT No.: PCT/JP87/00522

§ 371 Date: Apr. 15, 1988

§ 102(e) Date: Apr. 15, 1988

[87] PCT Pub. No.: WO88/01420

PCT Pub. Date: Feb. 25, 1988

[30] Foreign Application Priority Data

Aug. 22, 1986 [JP] Japan ..... 61-196900

[51] Int. Cl.[5] ..... G09G 1/16

[52] U.S. Cl. ..... 340/750; 340/747; 340/799

[58] Field of Search ..... 340/750, 799, 798, 747

[56] References Cited

U.S. PATENT DOCUMENTS 3,974,493 8/1976 Cavaignac ..... 340/750

4,368,466 1/1983 Paine ..... 340/799

*Primary Examiner*—Alvin E. Oberley

*Attorney, Agent, or Firm*—Staas & Halsey

[57] ABSTRACT

In providing overlapped displays of characters and graphics on a display unit, character data are arranged in the order of rows, while graphic data are divided into blocks corresponding to the rows of the character data and the data, which are extracted from the respective blocks in the order of lines, are arranged for each line in the order of the blocks. This eliminates the necessity of providing a remainder of address for each row which is instead provided at the end of each line of the graphic data so as to permit the transition to the next line by shifting the high-order digit of the address, and accordingly the utilization efficiency of a RAM is increased.

7 Claims, 3 Drawing Sheets

METHOD OF ARRANGING DATA ON A RAM FOR DISPLAY

TECHNICAL FIELD OF THE INVENTION

The present invention relates to a method of arranging data on a RAM for display and, more particularly, to a method of arranging data on a RAM for display which permits a more efficient utilization of the RAM in providing overlapping displays of characters and graphics on a display unit.

DESCRIPTION OF THE BACKGROUND ART

For providing overlapped displays of characters and graphics on a cathode ray tube (CRT) display or similar display unit, it is customary in the art to employ such a memory (RAM) constitution as shown in FIGS. 4A and 4B for a screen configuration depicted in FIG. 3.

In FIG. 3 the screen is 80 characters wide by 25 rows long. Generally characters are each composed of n lines for a single piece of display data (a character), and accordingly, lines of characters are each displayed in sequence; for example, when n=16, a line 0 of characters 0 to 79 is displayed, then a line 1 of characters 0 to 79 is displayed, followed by the subsequent lines of characters.

Conventionally, display data are arranged on the RAM as shown in FIGS. 4A and 4B so as to produce such a display as mentioned above.

FIG. 4A shows a memory constitution for characters, in which characters 0 to 79 of a first row, composed of 16 lines, are written in addresses 00000H to 0007FH and characters 80 to 159 of a second row are written in addresses 00080H to 000FFH. Similarly, characters of each of the subsequent rows are assigned addresses by steps of 80H; thus, characters of 25 rows are arranged on the memory. This is because the address structure is simplified by an arrangement in which the transition from one row composed of 80 characters, each 1 byte (=8 dots) wide, to the next row is made by shifting the high-order bit of the address of the preceding row by a predetermined number to the leading address of each line of the next row. To perform this, and unused area (a remainder) is provided at the end of each row.

FIG. 4B shows the arrangement of graphic data on the memory, in which graphic data corresponding to the first row of characters are arranged for each line; namely, data of a first line ① are written in addresses 10000H to 1007FH and then data of a second line ② are written in addresses 10080H to 100FFH. Similarly the subsequent lines are each assigned 80H addresses; thus, graphic data of 16 lines corresponding to the first row of character data are arranged on the memory. Next, graphic data corresponding to the second line of character data are similarly arranged for each line on the memory. In this way, graphic data corresponding to character data of 25 rows are arranged on the memory. In this instance, an unused area is provided at the end of each line as is the case with the character data. In the manner described just above, graphic data, including that corresponding to the last character of the 25th row, are arranged on the memory. The data thus arranged on the memory are read out in the order of ①, ②, . . . , ⑯, ⑰, . . . , ㊹㊹.

With the data arrangement on the memory shown in FIG. 4B, unused areas are provided at the ends of the rows and the lines so that the transition to the next character or line is made of shifting the high-order bit of the address of the preceding row or line by a predetermined number to the leading address of the next character or line, thereby simplifying the address structure.

The conventional method of data arrangement on the RAM depicted in FIGS. 4A and 4B have the defect that the overall utilization efficiency of the RAM is poor, because the unused area is provided for each row of character data and for each line of graphic data.

SUMMARY OF THE INVENTION

The present invention is intended to offer a solution to the above-mentioned defect of the prior art. According to the present invention, in a RAM for display adapted so that character data of plural rows, each composed of plural lines, and graphic data composed of plural lines are written in an overlapped manner and read out simultaneously, when the data are written, as follows

- the character data are arranged in the order of the rows;
- the graphic data are divided into blocks corresponding to the rows of the character data and the data, which are extracted from the respective blocks in the order of lines, are arranged for each line in the order of blocks;
- a remainder of an address is provided at the end of each line of the graphic data so that the transition to the next line is made by shifting the high-order digit of the address; and
- the character data are read out in the order of the lines for each row and the graphic data are read out in the order of the lines for each block.

That is, the character data are written in the order of their rows and the graphic data are divided into blocks corresponding to the rows of the character data and the data, which are extracted from the respective blocks in the order of lines are written for each line in the order of the blocks. When the memory is read out, the character data is read out in the order of the lines for each row, and the graphic data are read out in the order of the lines for each block. Accordingly, there in no need of providing the address remainder at the end of each line of the graphic data which is provided for making the transition to the next line by shifting the high-order digit of the address. This provides higher utilization of the RAM, and hence permits the reduction of its capacity.

DESCRIPTION OF THE PREFERRED EMBODIMENT

Figure 1A:
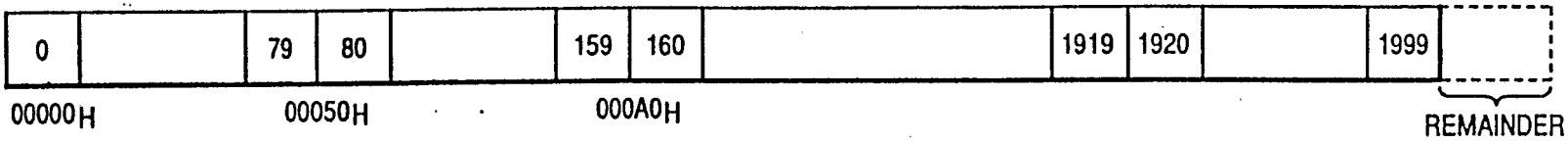
FIGS. 1A and 1B are diagrams showing data arrangement on the RAM in accordance with an embodiment of the present invention.
Figure 1B:
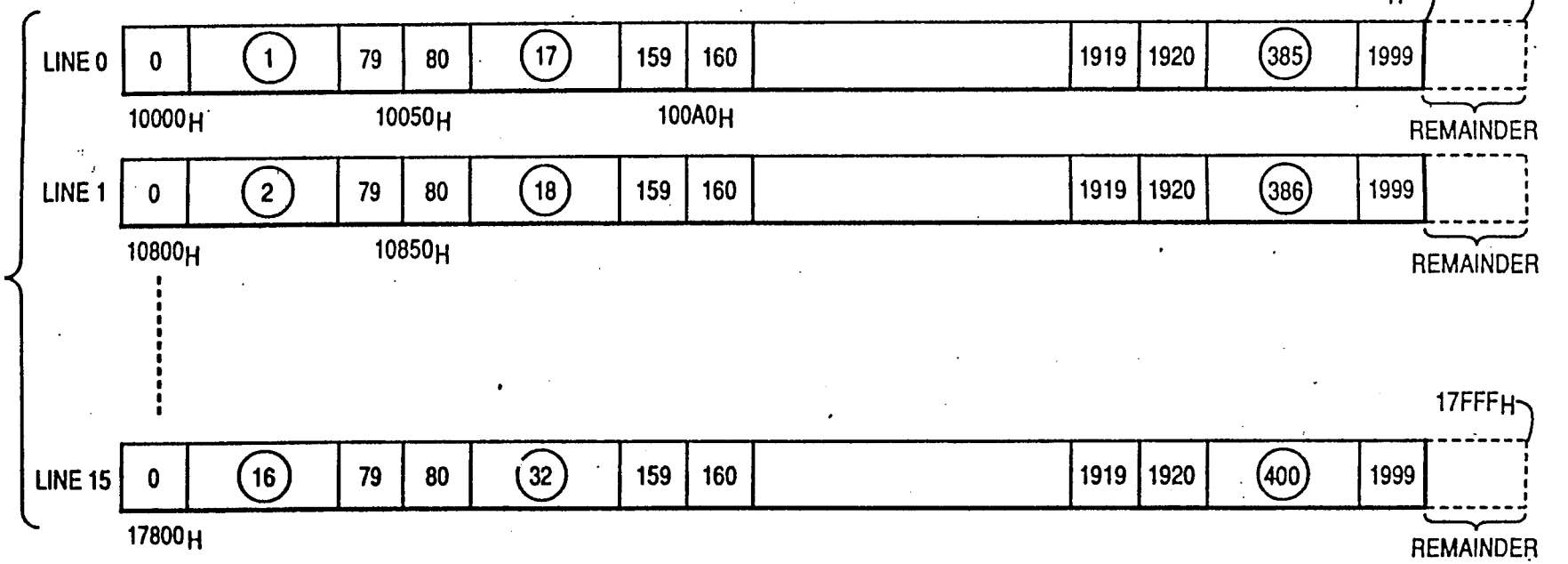
Figure 3:
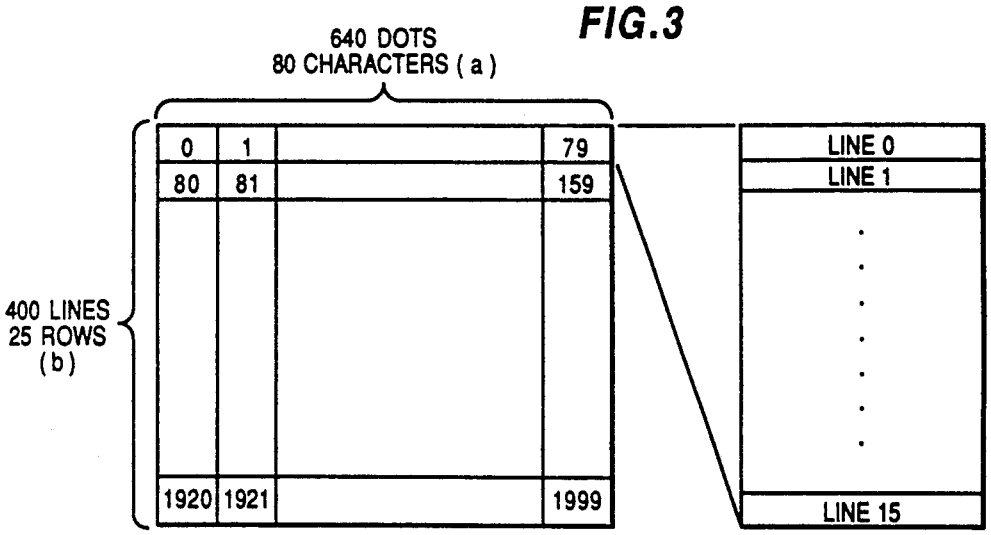
FIG. 3 is a diagram showing an example of the screen configuration to which the present invention and the prior art are applied.

FIGS. 1A and 1B illustrate the data arrangement on the RAM according to an embodiment of the present invention. The data arrangement shown in FIGS. 1A and 1B are intended for the screen configuration depicted in FIG. 3 and shows, by way of example, a memory constitution for the screen which is 80 characters wide by 25 rows long, as is the case with FIGS. 4A and 4B.

FIG. 1A shows a memory constitution for characters, in which characters 0 to 79 of a first row, composed of 16 lines, are written in addresses 00000H to 0004FH, characters 80 to 159 are written in addresses 00050H to 0009FH, and characters of each of the subsequent rows are similarly written in 50H addresses; thus, characters of 25 rows are arranged on the memory. Also in this case, each character is 1 byte (=8 bits) wide, and when processing proceeds from one row, composed of 80 characters, to the next row, no unused area is provided between the rows but the unused area is provided at the end of the last row alone.

FIG. 1B shows a memory constitution for graphic data, in which data of a line 0 is arranged in sequence for each row; namely, data of the zeroth row are written in addresses 100000H to 1004FH, data of the first row are written in addresses 10050H to 1009FH, and data of each of the subsequent rows are similarly written in 50H addresses; thus, data of the th line, composed of 25 rows, are arranged on the memory.

Next, each row of a line 1 in FIG. 1B is assigned an address larger than that of the corresponding row of the line 0 by 800H and data of the first line, composed of 25 rows, are similarly arranged on the memory.

Similarly, data of the subsequent lines to a 16th one are arranged on the memory. In this instance, no unused area is provided between the respective rows of each line but the unused area is provided at the end of the last row of each line so as to permit proceeding to the next line by only shifting the high-order bit of the address of the preceding line after adding thereto a predetermined value. In the example shown in FIG. 1, for example, the address of the last row of the 0th line is 107CFH but the unused area is added and the last address of the line 0 is 107FFH.

On the other hand, the readout of the graphic data thus written starts with reading out the data of each line corresponding to the zeroth row, in the sequence of the lines. ①, ②, . . . , ⑯ indicate the data read out corresponding to the zeroth row. Upon completion of the readout of the data of the zeroth row, data ⑰, ⑱, . . . , ㉜ of the first row are read out in the order of the lines. By reading out the data of each row in the order of the lines in this way, the graphic data are read out.

Figure 4A:
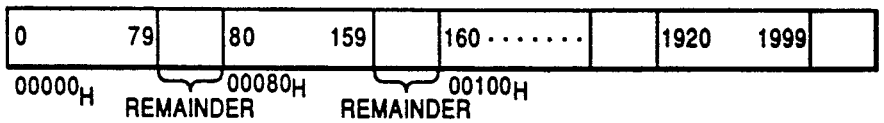
FIG.4A PRIOR ART
FIGS. 4A and 4B are diagrams showing the conventional data arrangement on the RAM.
Figure 4B:
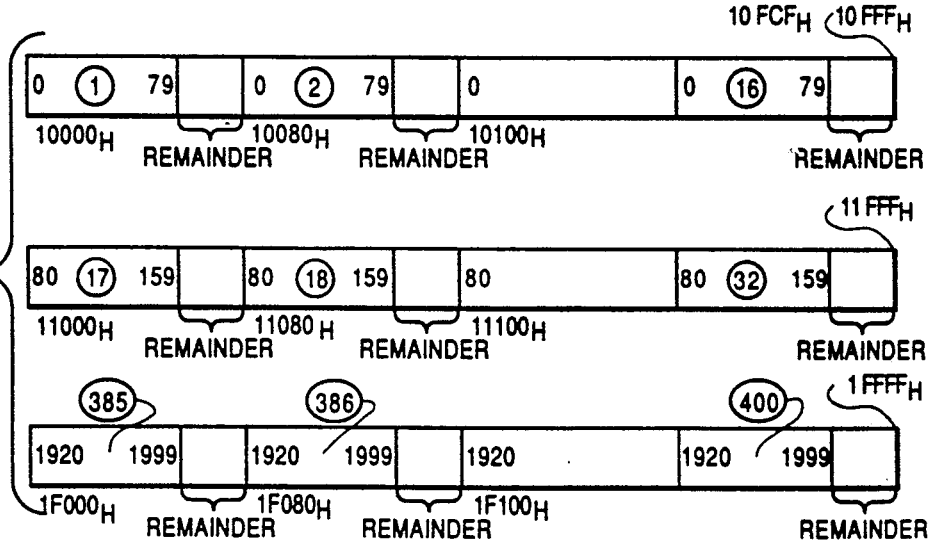
FIG.4B PRIOR ART

The method described above permits a sharp reduction of the unused areas on the RAM. Now, assuming that the conventional RAM arrangement shown in FIGS. 4A and 4B are a characters wide by b rows long, then the overall capacity needed for the RAM is as follows:

$$2^n \times 16 \times b \text{ bytes}$$

where:

$$2^{n-1} < a < 2^n.$$

On the other hand, the RAM arrangement of the present invention, described with respect to FIGS. 1A and 1B, needs only to have the following capacity:

$$2^m \times 16 \text{ bytes}$$

where:

$$2^{m-1} < a \times b \leqq 2^m.$$

For example, in the case of the afore-mentioned RAM arrangement that is 80 characters wide by 25 rows long, the conventional method requires, for graphic data, the following capacity:

$$128 \times 16 \times 25 = 51200 \text{ bytes},$$

but according to the method of the present invention, the following capcity will suffice:

$$2048 \times 16 = 32768 \text{ bytes}.$$

Thus, the RAM capacity needed is substantially reduced.

Figure 2:
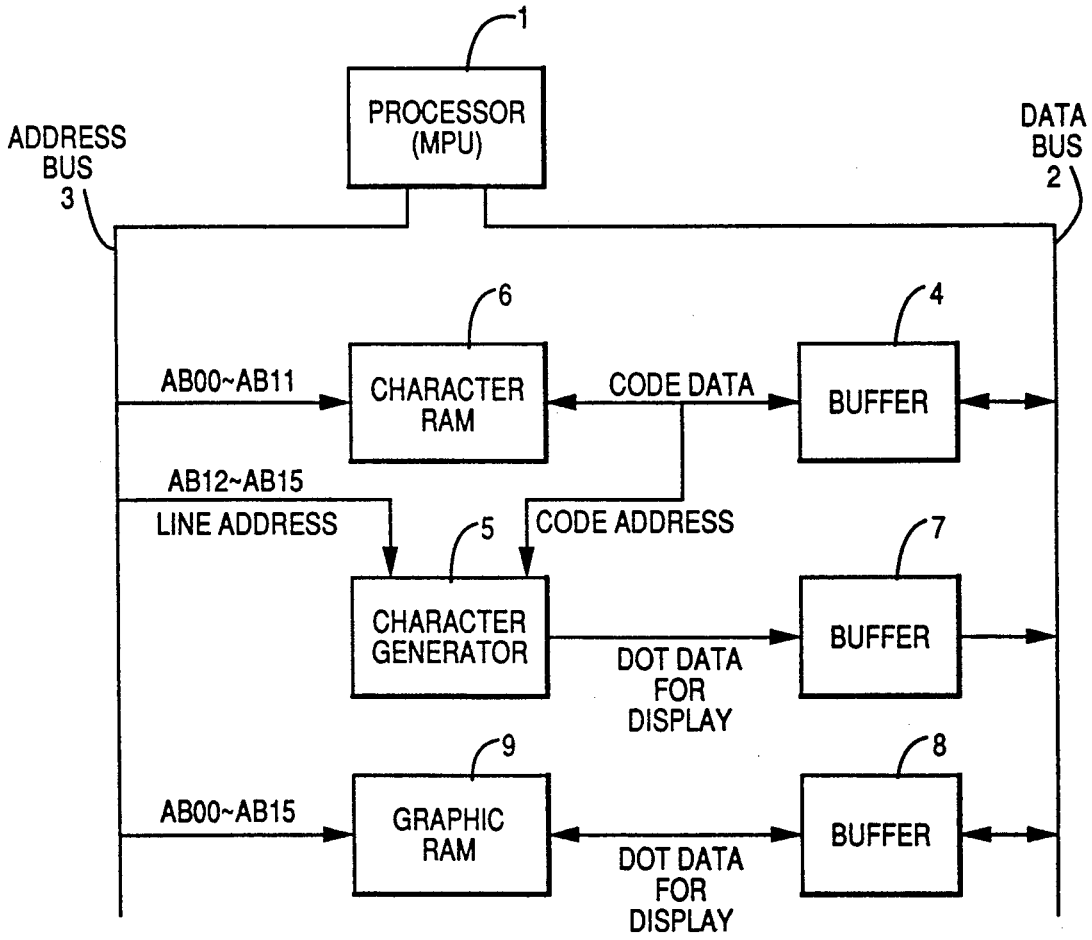
FIG. 2 is a diagram illustrating the circuit arrangement of an embodiment of the present invention.

FIG. 2 illustrates an example of the arrangement of a RAM write circuit which implements the method of data arrangement on the RAM according to the present invention.

In the case of writing character or graphic data into the RAM (not shown), a processor (MPU) 1 provides data and addresses on a data bus 2 and an address bus 3, respectively. When the data is character data, it is usually composed of codes representing a character and input as a code address into a character generator 5 via a buffer 4. On the other hand, the addresses are provided in the form of AB00 to AB15; the addresses AB00 to AB11 are to specify the addresses for writing characters into a character RAM 6 and the addresses AB12 to AB15 are those which indicate to the character generator 5 the lines which form the character. In accordance with the code address and the line address thus specified the character generator 5 outputs, for each specified line, dot data for display which correspond to the specified character. The display dot data is provided on the data bus 2 via a buffer 7 and is stored in the buffer 4, thereafter being written into the character RAM 6 for each line in accordance with the specified address.

On the other hand, when data is graphic data, it is composed of dot data for display nd is loaded into a buffer 8. Since addresses AB00 to AB15 directly specify an address of a graphic RAM 9, the display dot data is directly written in the specified address of the graphic RAM 9 from the buffer 8.

As described above, according to the present invention, in the case of producing overlapped displays of characters and graphics, the unused areas on the RAM for display are reduced, providing higher utilization of the RAM. This permits the reduction of the RAM capacity needed for the same display contents but without introducing complexity in the arrangements for write and read.

I claim:

1. A method of data arrangement in a memory for a display in which character data and graphical data are overlappingly displayed in plural rows, each of the rows includes plural lines and the memory including addresses having high-order and low-order address bits, comprising the steps of:

(a) dividing the graphic data into blocks, each of said blocks corresponding to a respective one of the rows and dividing each of said blocks into sub-blocks, each of said sub-blocks corresponding to a respective one of the lines;

(b) arranging in the memory the character data in the order of the rows;

(c) arranging in the memory said blocks in the order of the rows and arranging said sub-blocks so that the addresses associated with a respective one of said sub-blocks within a respective block have the same low-order address bits as the low-order address bits of addresses associated with a corresponding row of character data; and (d) performing an address transition from one sub-block to another sub-block of the same block by shifting the high-order address bits.

2. A method as recited in claim 1, further comprising the step of:

(e) reading from the memory the character data in the order of the rows and the graphic data in the order of lines for each block.

3. A method as recited in claim 2, wherein step (e) includes the sub-step of:

reading the character data and the graphic data from the memory simultaneously.

4. A method as recited in claim 1, further comprising the step of:

(e) providing in the memory a remainder at addresses after each of the sub-blocks of the block corresponding to a last row of the graphic data and after the last row of the character data.

5. A method as recited in claim 4, further comprising the step of:

(f) performing an address transition from a row of graphic data to corresponding row of character data by shifting a highest-order bit of the high-order bits.

6. A method as recited in claim 2, wherein step (c) includes the substep of:

arranging the lines within each row in order of the lines; and step (e) includes the substep of:

reading the character data in the order of the lines for each of the rows.

7. A method of data arrangement in a memory for displaying character data and graphic data in plural rows, each of the rows includes plural lines and the memory including addresses having plural address portions, comprising the step of:

(a) dividing the graphic data into blocks, each of said blocks corresponding to a respective one of the rows and dividing each of said blocks into sub-blocks, each of said sub-blocks corresponding to a respective one of the lines;

(b) writing the character data into the memory by arranging the character data in the order of the rows;

(c) writing the graphic data into the memory by arranging said blocks in the order of the rows and by arranging said sub-blocks so that the addresses associated with a respective one of said sub-blocks of one of said blocks have address portions equal to address portions of the addresses associated with a corresponding row of character data; and (d) performing an address transition from one sub-block to another sub-block of the same block by shifting high order address portions of the addresses.

* * * * *